US010543420B2

(12) United States Patent
Wu

(10) Patent No.: US 10,543,420 B2
(45) Date of Patent: Jan. 28, 2020

(54) SMOG MACHINE, METHOD AND APPARATUS FOR PROMPTING STATE INFORMATION OF A PHYSICAL GAME CHARACTER, AND REMOTE-CONTROL FIGHTING VEHICLE

(71) Applicant: SZ DJI TECHNOLOGY CO., LTD., Shenzhen (CN)

(72) Inventor: Xiaolong Wu, Shenzhen (CN)

(73) Assignee: SZ DJI TECHNOLOGY CO., LTD., Shenzhen (CN)

( * ) Notice: Subject to any disclaimer, the term of this patent is extended or adjusted under 35 U.S.C. 154(b) by 389 days.

(21) Appl. No.: 15/410,826

(22) Filed: Jan. 20, 2017

(65) Prior Publication Data

US 2017/0128825 A1 May 11, 2017

Related U.S. Application Data

(63) Continuation of application No. PCT/CN2014/083414, filed on Jul. 31, 2014.

(51) Int. Cl.
*A63F 9/02* (2006.01)
*A63H 17/26* (2006.01)
(Continued)

(52) U.S. Cl.
CPC ..... *A63F 9/02* (2013.01); *A63F 9/0243* (2013.01); *A63H 17/26* (2013.01); *A63H 17/32* (2013.01);
(Continued)

(58) Field of Classification Search
CPC ..... A63J 5/025
See application file for complete search history.

(56) References Cited

U.S. PATENT DOCUMENTS 3,986,670 A 10/1976 Syveson
4,741,717 A 5/1988 Wolf
(Continued)

FOREIGN PATENT DOCUMENTS

CN 2323836 Y 6/1999
CN 2784057 Y 5/2005
(Continued)

OTHER PUBLICATIONS

The World Intellectual Property Organization (WIPO) International Search Report for PCT/CN2014/083414 dated Apr. 22, 2015 pp. 1-8.
(Continued)

*Primary Examiner* — James S. McClellan
(74) *Attorney, Agent, or Firm* — Anova Law Group, PLLC

(57) ABSTRACT

A prompting device for prompting state information of a physical game character includes a smog machine and a control circuit. The smog machine include a smog chamber, a heating element, and an air-blowing device. The smog chamber has a receiving cavity for receiving smog fluid, an inlet, and an outlet. The inlet and the outlet are in communication with the receiving cavity. The heating element is mounted within the receiving cavity and generates heat to vaporize the smog fluid after an electric current is applied. The air-blowing device is disposed corresponding to the outlet for blowing an air flow towards the receiving cavity. The air flow generated by the air-blowing device enters into the receiving cavity from the inlet and discharges smog within the receiving cavity from outlet. The control circuit is configured to control the smog machine to generate the smog that characterizes the state information.

18 Claims, 11 Drawing Sheets

(51) Int. Cl.

| | |
|---|---|
| ***A63H 17/32*** | (2006.01) |
| ***A63H 23/10*** | (2006.01) |
| ***A63H 27/00*** | (2006.01) |
| ***A63H 30/04*** | (2006.01) |
| ***A63H 33/42*** | (2006.01) |

(52) U.S. Cl.

CPC ..... *A63H 23/10* (2013.01); *A63H 27/00* (2013.01); *A63H 30/04* (2013.01); *A63H 33/42* (2013.01)

(56) References Cited

U.S. PATENT DOCUMENTS

| | | | | |
|---|---|---|---|---|
| 4,990,290 | A | 2/1991 | Gill | |
| 6,580,368 | B1 * | 6/2003 | Jacobs | B60Q 1/482 116/209 |
| 2011/0142429 | A1 * | 6/2011 | Joseph | A63J 5/025 392/394 |
| 2014/0191057 | A1 | 7/2014 | Eames et al. | |

FOREIGN PATENT DOCUMENTS

| | | | |
|---|---|---|---|
| CN | 200966931 | Y | 10/2007 |
| CN | 201139960 | Y | 10/2008 |
| CN | 201422581 | Y | 3/2010 |
| CN | 201733847 | U | 2/2011 |
| CN | 102580311 | A | 7/2012 |
| CN | 203355308 | U | 12/2013 |
| CN | 204073364 | U | 1/2015 |
| JP | S56133366 | U | 3/1955 |
| JP | S60025088 | U | 2/1985 |
| JP | 3137640 | U | 12/2007 |
| WO | 2012057364 | A1 | 5/2012 |

OTHER PUBLICATIONS

Installation of Smoke Device, Hinoki's Model Workshop, Aug. 21, 2001, p. 1-6, Japan, http://web1.incl.ne.jp/hinoki/d6096g.html.

* cited by examiner

SMOG MACHINE, METHOD AND APPARATUS FOR PROMPTING STATE INFORMATION OF A PHYSICAL GAME CHARACTER, AND REMOTE-CONTROL FIGHTING VEHICLE

CROSS-REFERENCE TO RELATED APPLICATION

This is a continuation application of International Application No. PCT/CN2014/083414, filed on Jul. 31, 2014, the entire contents of which are incorporated herein by reference.

TECHNICAL FIELD

The present disclosure relates to a smog machine, particularly an electrical heating type smog machine, a method and device for prompting state information of a physical game character, as well as a remote-control fighting vehicle.

BACKGROUND

At present, traditional smog technologies may be mostly used for killing insects, expelling insects, used in entertainment places, and humidifying places. There may be a variety of ways to make smog. For example, solid smog is a kind of smog formed by suspended particles in the air produced through incomplete combustion, but the smog produced by such scheme has a strong pungent smell and it is difficult to disperse within a bad-ventilated place. The amount of smog produced by a humidifier is small and the visibility the smog is poor. Smog fluid vaporization equipment used in entertainment places has a large volume and generates a huge amount of smog, but it is not suitable for miniaturized usage. Further, such equipment has a complex structure, and requires a big power supply apparatus. The traditional dry ice smog generator requires dry ice as a smog source to form a smog effect in the air, but the dry ice is a highly volatile smog source and could not be kept for a long time, and it is easy to damage the dry ice smog machine during use. A dry ice smog machine also requires to be a large scale apparatus, it is not easy to be miniaturized and light-weighted.

SUMMARY

In view of the above, the present disclosure provides a smog machine that may facilitate a miniaturized design, generate a larger amount of smog, and have a higher efficiency.

A smog machine includes a smog chamber having a receiving cavity, an inlet and an outlet, the inlet and the outlet may be in communication with the receiving cavity, the receiving cavity may be configured for receiving smog fluid; a heating element mounted within the receiving cavity, the heating element may be configured to generate heat to vaporize the smog fluid after an electric current is applied; and an air-blowing device disposed corresponding to the inlet for blowing an air flow towards the receiving cavity. In some embodiments, the air flow generated by the air-blowing device may enter into the receiving cavity from the inlet and discharge smog within the receiving cavity from the outlet.

The above-described smog machine may at least have advantages as follows:

(1) The above-described smog machine may heat the smog fluid within the smog chamber by the heating element, vaporize the smog fluid into the smog, and discharge the smog out of the smog chamber by the air-blowing device, the described smog machine has a more compact structure to facilitate the miniaturized design thereof.

(2) The above-described smog machine may vaporize the smog fluid in a manner that the heating element electrically heats, its manner of producing the smog is simple and quick controllable.

(3) The above-described smog machine may discharge the smog out of the smog chamber through the air-blowing device, so as to cause the smog within the smog chamber to flow out quickly, having a higher efficiency for producing the smog, and capable of producing a large amount of smog in a short time.

(4) The above-described smog machine may have a bulged surface provided on the inner surface of the covering plate of the smog chamber, in this way the liquid condensed during the discharging of the smog may return into the main chamber smoothly, thereby preventing diffusion and the contamination of the smog fluid.

(5) The inlet of the smog chamber of the above-described smog machine may be provided with an inclined guiding portion to elevate the wind flow to the upper half portion of the smog chamber, such that the smog may be discharged quickly, and it can prevent a flow of smog from forming a vortex within the main chamber, thereby further improving the efficiency for generating the smog.

In some embodiments, an orientation of the inlet and an orientation of the outlet may be located on the same axis; or the orientation of the inlet and the orientation of the outlet may be parallel to each other; or the orientation of the inlet and the orientation of the outlet may intersect.

In some embodiments, the inlet may be an air-blowing tube connected with the smog chamber; or the inlet may be a window provided on an outer sidewall on the smog chamber; or the inlet may be a mesh provided on the outer sidewall on the smog chamber.

In some embodiments, the outlet may be an air exhaust tube connected with the smog chamber; or the outlet may be a window provided on an outer sidewall on the smog chamber; or the outlet may be a mesh provided on the outer sidewall on the smog chamber.

In some embodiments, the outlet may be provided at a top surface of the smog chamber, the inlet may be provided at a side surface of the smog chamber.

In some embodiments, the inlet may be a window provided on a side surface of the smog chamber, and a guiding ring corresponding to the inlet may be provided on the side surface of the smog chamber, the air flow generated by the air-blowing device may enter into the inlet through the guiding ring.

In some embodiments, an inclined guiding portion may be provided on an inner wall of the guiding ring, the inclined guiding portion may be inclined towards the outlet to blow the air flow generated by the air-blowing device into the receiving cavity towards a side where the outlet is located.

In some embodiments, the outlet may be a window provided on a top surface of the smog chamber, the smog chamber may further comprise a covering plate for covering the window, a surface of the covering plate towards the receiving cavity may form a bulged surface bulging outward, and the covering plate may be provided with a ventilation mesh thereon that penetrates through the bulged surface.

In some embodiments, the bulged surface may be in a circular arc shape, an elliptical arc shape, a pyramid shape, a truncated pyramid shape, a truncated conical shape or a conical shape.

In some embodiments, the smog chamber may further comprise a reflux tube in communication with the outlet, one opening end of the reflux tube may be a large diameter end, the other one opening end of the reflux tube may be a small diameter end, the large diameter end and the outlet may be connected correspondingly, the covering plate may be disposed at the small diameter end.

In some embodiments, a bottom wall of the receiving cavity of the smog chamber may be provided with a fluid groove within which the smog fluid is held.

In some embodiments, there may be a plurality of fluid grooves that are independent mutually, the plurality of fluid grooves may be configured to hold different colors of smog fluid; there may be a plurality of heating elements configured respectively for heating the smog fluid within the plurality of fluid grooves.

In some embodiments, the smog fluid may comprise glycerol, ethylene glycol, or propylene glycol, and a colorant; or the smog machine may further comprise an RGB LED disposed close to the outlet, a light beam generated by the RGB LED may illuminate on smog coming out from the outlet.

In some embodiments, a wire-fixing pillar may be provided on a bottom wall of the receiving cavity for fixing the heating element.

In some embodiments, the heating element may be a solid resistance wire or a hollow heating tube, and is wrapped with a cotton core for absorbing the smog fluid.

In some embodiments, the heating element may be bent into a U-shaped structure disposed around three inner walls of the receiving cavity, an opening formed by two ends of the heating element may be disposed towards the inlet.

In some embodiments, the heating element may be electrically connected with a power line to apply an electric current directly to the heating element; or the smog machine may further comprise an electromagnetic device for generating a variable frequency electromagnetic field, the heating element may generate an induced current within the electromagnetic field generated by the electromagnetic device.

In some embodiments, the air-blowing device may be a direct current centrifugal ventilator or a direct current fan.

In some embodiments, the smog machine may further comprise a heat insulation element disposed close to an inner wall of the receiving cavity for preventing heat of the receiving cavity from leakage.

In some embodiments, the heat insulation element may be a high temperature heat insulation plastic sheet or a layer of heat insulation cotton attached to the inner wall of the receiving cavity.

In some embodiments, the smog machine may further comprise a reflective element disposed close to an inner wall of the receiving cavity for reflecting infrared radiation.

In some embodiments, the reflective element may be a glass sheet, a mirror, or a metal sheet.

In some embodiments, a bottom wall of the receiving cavity may be provided with a fastening slot close to a sidewall, the reflective element may be fastened within the fastening slot.

Meanwhile, the present disclosure further provides a prompting device for prompting state information of a physical game character.

A prompting device for prompting a state information of a physical game character may comprise: a smog machine comprising a smog chamber, a heating element and an air-blowing device; the smog chamber may have a receiving cavity for receiving smog fluid, an inlet and an outlet, the inlet and the outlet may be in communication with the receiving cavity; the heating element may be mounted within the receiving cavity, the heating element may generate heat to vaporize the smog fluid after an electric current is applied; the air-blowing device may be disposed corresponding to the outlet for blowing an air flow towards the receiving cavity; the air flow generated by the air-blowing device may enter into the receiving cavity from the inlet and discharge smog within the receiving cavity from outlet; a controlling circuit configured to control the smog machine to generate the smog that characterizes the state information of the physical game character.

The above-described prompting device may at least have advantages as follows:

(1) The above-described prompting device may prompt the state information of the physical game character by the smog produced by the smog machine, so as to facilitate a game participant to be able to see clearly the state information of the physical game character at different viewing angles, achieving a good visual effect.

(2) The above-described prompting device may produce different forms of smog by the smog machine to characterize different state information of the physical game character, achieving a better adaptability.

In some embodiments, the controlling circuit controls the smog machine may comprise at least one of the followings: controlling power-on and power-off of the heating element, controlling a magnitude of a current on the beating element, controlling a power-on time of the heating element, controlling a color of the smog generated by the smog machine, and controlling an amount of the air flow generated by the air-blowing device.

In some embodiments, the controlling circuit may control a different concentration and/or different color of the smog generated by the smog machine to characterize a life value for the physical game character.

In some embodiments, when the life value for the physical game character is below a preset greater-than-zero value, the controlling circuit may control the smog machine to start to generate the smog; or when the life value for the physical game character is zero, the controlling circuit may control the smog machine to start to generate the smog; or when the life value for the physical game character is below the preset greater-than-zero value, the controlling circuit may control the smog machine to start to generate the smog in one color; when the life value for the physical game character is zero, the controlling circuit may control the smog machine to start to generate the smog in another color; or when the life value for the physical game character is below the preset greater-than-zero value, the controlling circuit may control the smog machine to start to generate the smog with a smaller concentration; when the life value for the physical game character is zero, the controlling circuit may control the smog machine to start to generate the smog with a larger concentration.

In some embodiments, an orientation of the inlet and an orientation of the outlet may be located on the same axis; or the orientation of the inlet and the orientation of the outlet may be parallel to each other; or the orientation of the inlet and the orientation of the outlet may intersect.

In some embodiments, the inlet may be an air-blowing tube connected with the smog chamber; or the inlet may be a window provided on an outer sidewall on the smog chamber; or the inlet may be a mesh provided on the outer sidewall on the smog chamber.

In some embodiments, the outlet may be an air exhaust tube connected with the smog chamber; or the outlet may be a window provided on an outer sidewall on the smog chamber; or the outlet may be a mesh provided on the outer sidewall on the smog chamber.

In some embodiments, the outlet nay be provided at a top surface of the smog chamber, the inlet may be provided at a side surface of the smog chamber.

In some embodiments, the inlet may be a window provided on a side surface of the smog chamber, and a guiding ring corresponding to the inlet may be provided on a side surface of the smog chamber, an air flow generated by the air-blowing device may enter into the inlet through the guiding ring.

In some embodiments, an inclined guiding portion may be provided on an inner wall of the guiding ring, the inclined guiding portion may be inclined towards the outlet to blow the air flow generated by the air-blowing device into the receiving cavity towards a side where the outlet is located.

In some embodiments, the outlet may be a window provided on a top surface of the smog chamber, the smog chamber may further comprise a covering plate for covering the window, a surface of the covering plate towards the receiving cavity may form a bulged surface bulging outward, and the covering plate may be provided with a ventilation mesh thereon that penetrates through the bulged surface.

In some embodiments, the bulged surface may be in a circular arc shape, an elliptical arc shape, a pyramid shape, a truncated pyramid shape, a truncated conical shape or a conical shape.

In some embodiments, the smog chamber may further comprise a reflux tube in communication with the outlet, one of opening ends of the reflux tube may be a large diameter end, another one of the opening ends of the reflux tube may be a small diameter end, the large diameter end and the outlet may be connected correspondingly, the covering plate may be disposed at the small diameter end.

In some embodiments, a bottom wall of the receiving cavity of the smog chamber may be provided with a fluid groove within which the smog fluid is hold.

In some embodiments, there may be a plurality of fluid grooves that are mutually independent, the plurality of fluid grooves may be configured to hold different colors of smog fluid; there may be a plurality of heating elements configured respectively for heating the smog fluid within the plurality of fluid grooves.

In some embodiments, the smog fluid may comprise glycerol, ethylene glycol, propylene glycol and colorant; or the smog machine may further comprise an RGB LED disposed close to the outlet, a light beam generated by the RGB LED may illuminate on smog coming out from the outlet.

In some embodiments, a wire-fixing pillar may be provided on a bottom wall of the receiving cavity for fixing the heating element.

In some embodiments, the heating element may be a solid resistance wire or a hollow heating tube, and the heating element is wrapped with a cotton core for absorbing the smog fluid.

In some embodiments, the heating element may be bent into a U-shaped structure disposed around three inner walls of the receiving cavity, an opening formed by two ends of the heating element may be disposed towards the inlet.

In some embodiments, the heating element may be electrically connected with a power line to apply an electric current directly to the heating element, the controlling circuit may comprise a switch circuit for controlling on and off of the power line rid a resistor for adjusting a magnitude of a current on the heating element; or the smog machine may further comprise an electromagnetic device for generating a variable frequency electromagnetic field, the heating element may generate an induced current within the electromagnetic field generated by the electromagnetic device, the controlling circuit may comprise a switch circuit for controlling a working state of the electromagnetic device.

In some embodiments, the air-blowing device may be a direct current centrifugal ventilator or a direct current fan, the controlling circuit may comprise a speed adjustor for controlling a rotating speed of the air-blowing device and a switch circuit for controlling a power-on and power-off of the air-blowing device.

In some embodiments, the prompting device may further comprise a heat insulation element disposed close to an inner wall of the receiving cavity for preventing heat of the receiving cavity from leakage.

In some embodiments, the heat insulation element may be a high temperature beat insulation plastic sheet or a layer of heat insulation cotton attached to the inner wall of the receiving cavity.

In some embodiments, the prompting device may further comprise a reflective element disposed close to an inner wall of the receiving cavity for reflecting infrared radiation.

In some embodiments, the reflective element may be a glass sheet, a mirror, or a metal sheet.

In some embodiments, the controlling circuit may comprise at least one of the followings: a speed adjustor, a resistor, a switch circuit, and a microprocessor.

In addition, the present disclosure further provides a remote-control fighting vehicle applying the above-described prompting device.

A remote-control fighting vehicle may comprise: the above-described prompting device; and an sensing device configured for detecting whether it is shot by an external projectile and generating a respective sensing signal; a main controller connected in communication with the controlling circuit and the sensing device, for receiving the sensing signal, and outputting a respective control signal to the controlling circuit according to the sensing signal.

The above-described remote-control fighting vehicle may at least have advantages as follows:

(1) The above-described remote-control fighting vehicle may prompt the state information of the physical game character by the smog generated by the smog machine, so as to facilitate a game participant to see clearly the state information of the physical game character at different viewing angles, and to facilitate a manipulation of the remote-control fighting vehicle.

(2) The above-described remote-control fighting vehicle may produce different forms of smog by the smog machine to characterize different state information of the physical game character, so as to manipulate the remote-control fighting vehicle more flexibly.

In some embodiments, the sensing device may comprise a sensor disposed on an outer surface of the remote-control fighting vehicle and configured for detecting whether the outer surface of the remote-control fighting vehicle is hit by an external projectile.

In some embodiments, the sensor may comprise at least one of the followings: an acceleration sensor, an infrared ray sensor, a notion sensor, a proximity sensor, a visual sensor, a position sensor, and a distance sensor.

A prompting method for prompting a state information of a physical game character is provided, the prompting method employs the above-described smog machine, the prompting method may comprise steps as follows: obtaining the state information of the physical game character; controlling the smog machine to venerate a respective form of smog according to the state information of the physical game character.

The above-described prompting method may at least have advantages as follows:

(1) The above-described prompting method may prompt the state information of the physical game character by the smog produced by the smog machine, so as to facilitate a game participant to see clearly the state information of the physical game character at different viewing angles, and to achieve a good visual effect.

(2) The above-described prompting method may produce different forms of smog by the smog machine to characterize different state information of the physical game character, achieving a better adaptability.

In some embodiments, the state information of the physical game character may comprise at least one of the followings: life value, getting shot, hitting a landmine, hitting a trap, being frozen, being dizzied, and being died.

In some embodiments, the state information may be generated when the physical game character is shot by an external light beam and/or a material object; the external light beam comprises at least one of visible light and invisible light.

In some embodiments, the state information of the physical game character may be obtained by its own sensor comprising at least one of the followings: an acceleration sensor, an infrared ray sensor, a motion sensor, a proximity sensor, a visual sensor, a position sensor, and a distance sensor.

In some embodiments, the form of the smog may comprise at least one of the followings: the concentration of the smog, the time when the smog is generated, and the color of the smog.

In some embodiments, the state information of the physical game character may be change information of the life value of the physical game character.

In some embodiments, the smog machine may be controlled to start to generate the smog when the life value for the physical game character is below a preset greater-than-zero value; or the smog machine may be controlled to start to generate the smog when the life value for the physical game character is zero; or the smog machine may be controlled to start to generate the smog in one color when the life value for the physical game character is below a preset greater-than-zero value; the smog machine may be controlled to start to generate the smog in another color when the life value for the physical game character is zero; or the smog machine may be controlled to start to generate the smog with a smaller concentration when the life value for the physical game character is below a preset greater-than-zero value; the smog machine may be controlled to start to generate the smog with a larger concentration when the life value for the physical game character is zero.

In some embodiments, the physical game character may comprise at least one of the followings: a terrestrial fixed facility, a remote-control terrestrial moving device, a remote-control aerial moving device, a remote-control over-water moving device, and a remote-control underwater moving device.

In some embodiments, the state information is generated when the physical game character is shot by an external light beam and/or a material object, the external light beam comprises at least one of visible light and invisible light.

DETAILED DESCRIPTION

Figure 1:
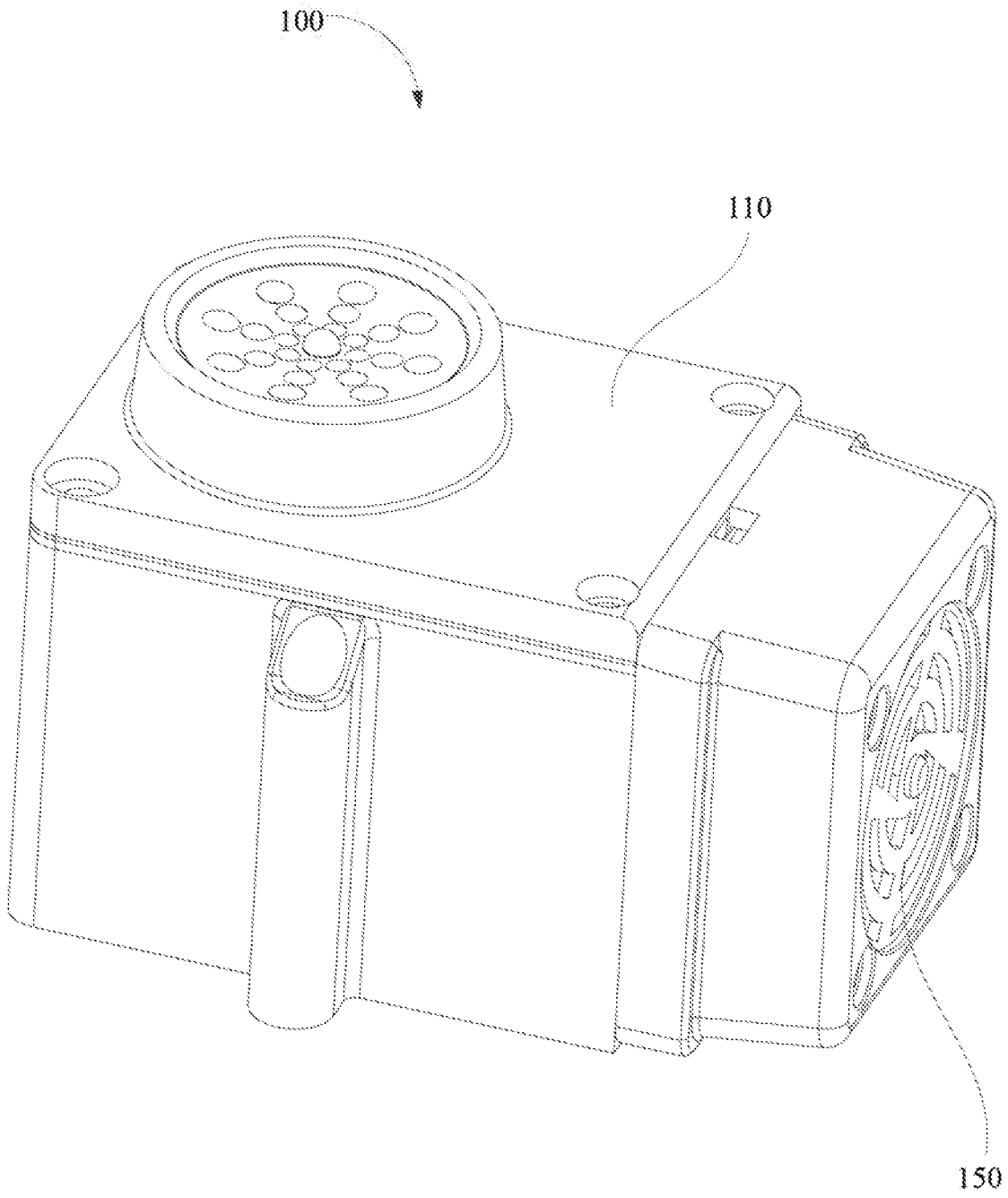
FIG. 1 is a perceptive view of a smog machine according to an embodiment of the present disclosure.

The technical solutions in the embodiments of the present disclosure will be described clearly and completely below in combination with the drawings. It should be apparent that embodiments described herein are only a part of the embodiments of the present disclosure. All other embodiments obtained by those with ordinary skills in the art on the basis of the disclosed embodiments without inventive efforts should fall within the scope of the present disclosure.

The present disclosure provides a smog machine comprising a smog chamber for receiving smog fluid, a heating element for heating to vaporize the smog fluid, and an air-blowing device for discharging the vaporized smog. The smog chamber may be provided with an inlet for introducing an air flow and an outlet for discharging smog. As used herein, a smog may refer to any visible smoke, fog, haze, cloud, or other atmospheric effect, or any invisible atmospheric effect that can be made visible through other means, such as light. A smog fluid may include any liquid that can be used to generate the smog.

In some embodiments, the orientation of the inlet, the direction in which the inlet faces, and the orientation of the outlet may be located on the same axis. Alternatively, the orientation of the inlet and the orientation of the outlet may be parallel to each other. Alternatively, the orientation of the inlet and the orientation of the outlet may be intersected, for example, inclined or perpendicularly.

In some embodiments, the inlet may have different specific structures. For example, the inlet may be an air-blowing tube connected with the smog chamber, or a window provided on an outer sidewall on the smog chamber, or a mesh provided on the outer sidewall on the smog chamber.

In some embodiments, the outlet may also have different specific structures. For example, the outlet may be an air exhaust tube connected with the smog chamber, or a window provided on an outer sidewall on the smog chamber, or a mesh provided on the outer sidewall on the smog chamber.

In some embodiments, the heating element may be heated by directly applying an electric current or by an induced current.

In some embodiments, the vaporized smog may have various different colors, for example, red, green, yellow, blue and the like.

In some embodiments, the vaporized smog may be colored by the way of self-coloring. For example, a colorant may be added into the smog fluid to form smog fluid of different colors, thereby forming smog with different colors titter vaporization. Further, the vaporized smog may be colored by the way of rendering with an external light. For example, the smog machine may further comprise an RGB LED (LED with three primary colors, i.e., an LED that may emit lights with three primary colors simultaneously) disposed close to the outlet, and light beam beams generated by the RGB LED may illuminate the smog coming out of the outlet, rendering the smog in required colors.

In some embodiments, the specific structure of the heating element may be in different shapes. For example, the heating element may be a solid resistance wire or a hollow electric heating rube.

Based on the above-described suing machine, a prompting method and a prompting device for prompting a state information of a physical game character are provided. A physical game character may refer to an actual object, living subject, or person used or being in a game as a pan of the game.

The prompting device may comprise a smog machine and a controlling circuit configured to control the smog machine to generate smog that may characterize the state information of the physical game character.

The prompting method may control the smog machine to generate a respective form of smog according to the state information of the physical game character.

In some embodiments, the controlling circuit may be configured to control the smog machine in a variety of ways. For example, the controlling circuit may be configured to control power-on or power-off of the heating element; the controlling circuit may be configured to control the magnitude of the electric current on the heating element; the controlling circuit may be configured to control the power-on time of the heating element; the controlling circuit may be configured to control the color of the smog generated by the smog machine; or the controlling circuit may be configured to control the amount of air flow generated by the air-blowing device. Alternatively, the controlling circuit may be configured to control the smog machine a any combination of the above described various ways.

In some embodiments, a variety of forms of the smog may be generated by the smog machine to characterize the state information of the physical game character. For example, different concentrations and/or different colors of smog may be used to characterize the state information of the physical game character, and the time point when the smog comes out may also be used to characterize the state information of the physical game character.

In some embodiments, the state information of the physical game character may have a variety of categories. For example, the state information may be a life value for the physical game character, whether hit a landmine or not, whether hit a trap or not, whether shot or not, whether frozen or not, whether dizzy or not, whether died or not, and so on.

In some embodiments, the physical game character may be a terrestrial fixed for example, a gun turret, a guard tower and an obstacle-wall and the like in a game simulating an actual war.

The physical game character may be a remote-control terrestrial moving device, for example, a remote-control toy fighting vehicle, a remote-control toy robot and the like.

The physical game character may also be a remote-control aerial moving device, for example, an unmanned aerial vehicle (UAV), a remote-control balloon and the like.

The physical game character may also be a remote-control overwater moving device, for example, a remote-control toy warship, a remote-control toy powerboat and the like.

The physical game character may also be a remote-control underwater moving device, for example, a remote-control toy fish, a remote-control toy submarine and the like.

The physical game character may also be a real person, or a manned terrestrial moving device, a manned overwater moving device, a manned underwater moving device, a manned aerial moving device and the like.

In some embodiments, the state information may be generated when the physical game character is shot or hit by an external light beam. For example, the generation of the state information may be triggered when the physical game character is shot by an infrared ray or a laser beam. The state information may be generated when the physical game character is shot by an external object. For example, the generation of the state information of the physical game character may be triggered when being shot by a BB pellet.

Based on the above-described prompting device, a remote-control fighting vehicle is also provided. The remote-control fighting vehicle may comprise a prompting device, a sensing device and a main controller. The sensing device may be configured to sense or detect whether it is hit or shot by an external projectile and generate a respective sensing signal. The main controller may be configured to receive the sensing signal and output a respective control signal to the controlling circuit according to the sensing signal. The controlling circuit may be configured to control the smog machine to generate a respective form of smog, and to prompt the state information of the remote-control fighting vehicle.

In some embodiments, the sensing device may comprise a sensor disposed on an outer surface of the remote-control fighting vehicle. The sensor may be configured to sense or detect whether the outer surface of the remote-control fighting vehicle is hit or shot by an external projectile or not. The sensor may be an acceleration sensor, an infrared sensor, a motion sensor, a proximity sensor, a visual sensor, a position sensor, and/or a distance sensor or the like.

In some embodiments, the main controller may be integrated with the controlling circuit of the prompting device, or may be disposed separately.

Some embodiments, of the present disclosure may be described in details below in conjunction with the drawings.

Figure 2:
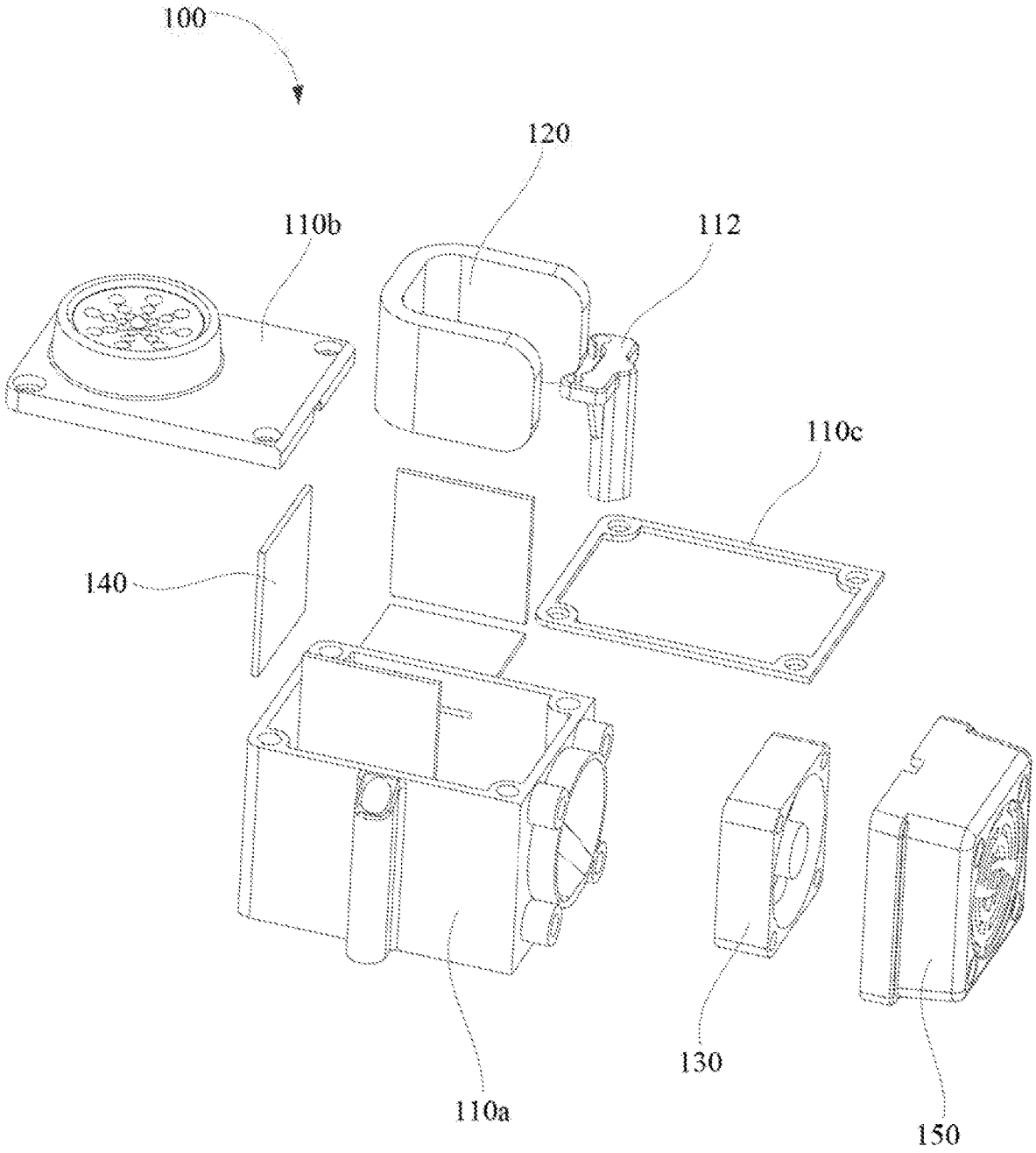
FIG. 2 is a exploded view of the smog machine as shown in FIG. 1.

Referring to FIGS. 1-2, a smog machine 100 according to an embodiment may comprise a smog chamber 110, a heating element 120, and an air-blowing device 130. The smog chamber 110 may be configured to receive smog fluid, the heating element 120 may be configured to electrically heat the smog fluid to vaporize it to generate smog, and the air-blowing device 130 may be configured to discharge the smog.

Figure 3:
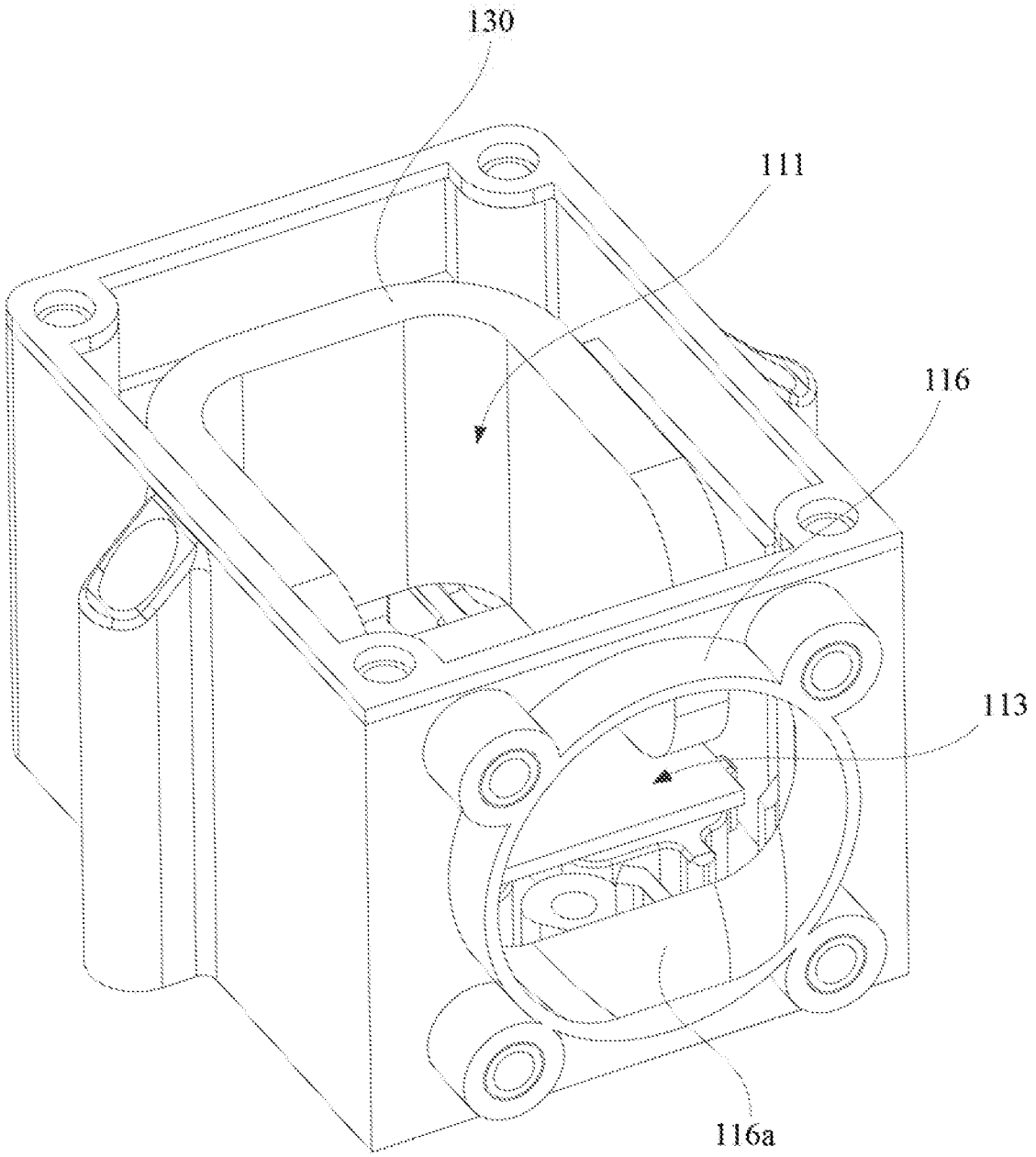
FIG. 3 is a perceptive view of a smog chamber of the smog machine as shown in FIG. 1 mounted with a heating element.
Figure 7:
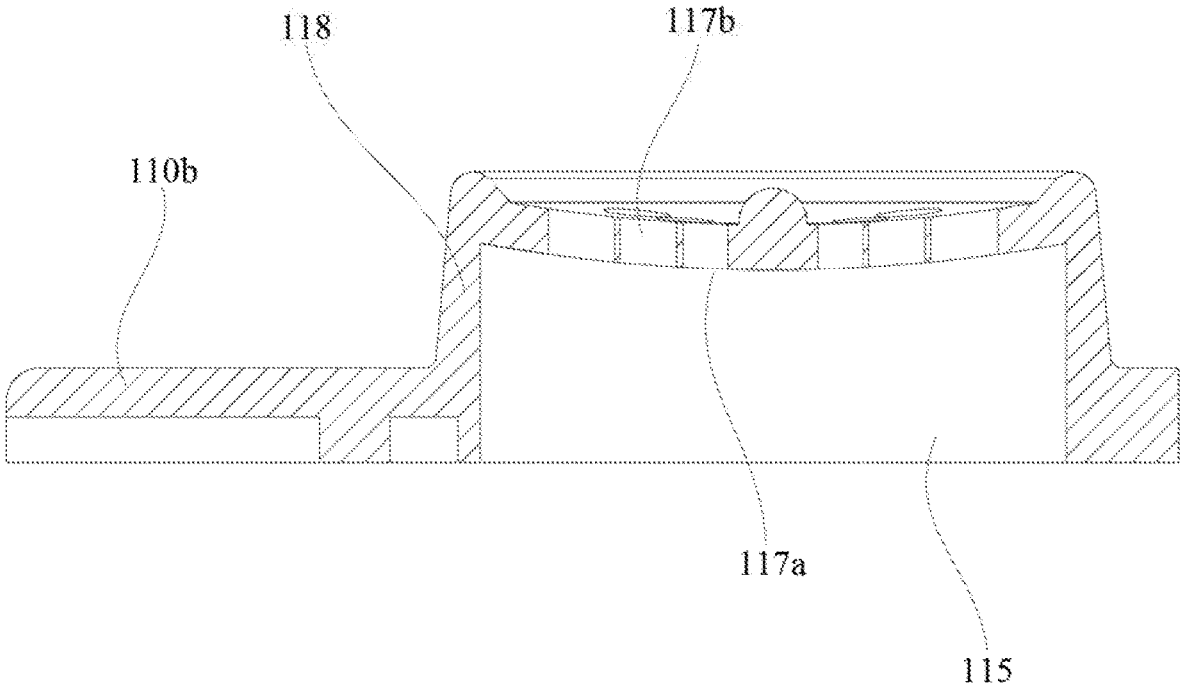
FIG. 7 is a cross sectional view of the upper cover of the smog chamber of the smog machine as shown in FIG. 6.

Referring to FIG. 3 and FIG. 7, the smog chamber 110 may have a receiving cavity 111, an inlet 113 and an outlet 115, the inlet 113 and the outlet 115 may be in communication with the receiving cavity 111, and the receiving cavity 111 may be configured to receive the smog fluid (not shown).

The smog chamber 110 may be in any appropriate shape, for example, a sphere, a cube, a circular truncated-cone, or a frustum of a prism, etc. Specifically, in the illustrated embodiments, the smog chamber 110 may be a cube. Specifically, as shown in FIG. 2, the smog chamber 110 may comprise a lower housing 110*a* and an upper cover 110*b*, the lower housing 110*a* may be a cubic housing with an opening on one side surface, and the upper cover 110*b* is a covering plate matching the shape of the opening of the cubic housing for sealing the opening of the cubic housing.

Further, a sealing gasket 110*c* (as shown in FIG. 2) may be disposed between the upper cover 110*b* and the periphery of the opening of the lower housing 110*a*, so as to enhance the airtightness between the upper cover 110*b* and the periphery of the opening of the lower housing 110*a*.

The orientations of the inlet 113 and the outlet 115 may be designed according to requirements. For example, the orientations of the inlet 113 and the outlet 115 may be located on the same axis; alternatively, the orientations of the inlet 113 and the outlet 115 may be parallel to each other; alternatively, the orientations of the inlet 113 and the outlet 115 may be intersected.

The specific structure of the inlet 113 may be designed according to different requirements. For example, the inlet may be an air-blowing tube connected with the smog chamber 110; the inlet may be a window provided on an outer sidewall on the smog chamber 110; or the inlet may be a mesh provided on the outer sidewall on the smog chamber 110.

Specifically, in the illustrated embodiments, the inlet 113 may be a window provided on a side of the smog chamber 110, and a guiding ring 116 as shown in FIG. 3) corresponding to the inlet 113 may be provided on a side surface of the smog chamber 110, an air flow generated by the air-blowing device 130 may enter into the inlet 113 though the guiding ring 116.

Further, an inclined guiding portion 116*a* may be provided on an inner wall of the guiding ring 116 and inclined towards the outlet 115, to blow the air flow generated by the air blowing device 130 into the receiving cavity 111 towards the side where the outlet 115 is located.

Specifically, the guiding ring 116 is a circular ring, the inclined guiding portion 116*a* is an inclined surface on a portion of the guiding ring 116 close to a bottom wall of the receiving cavity 111 of the smog chamber 110.

Figure 4:
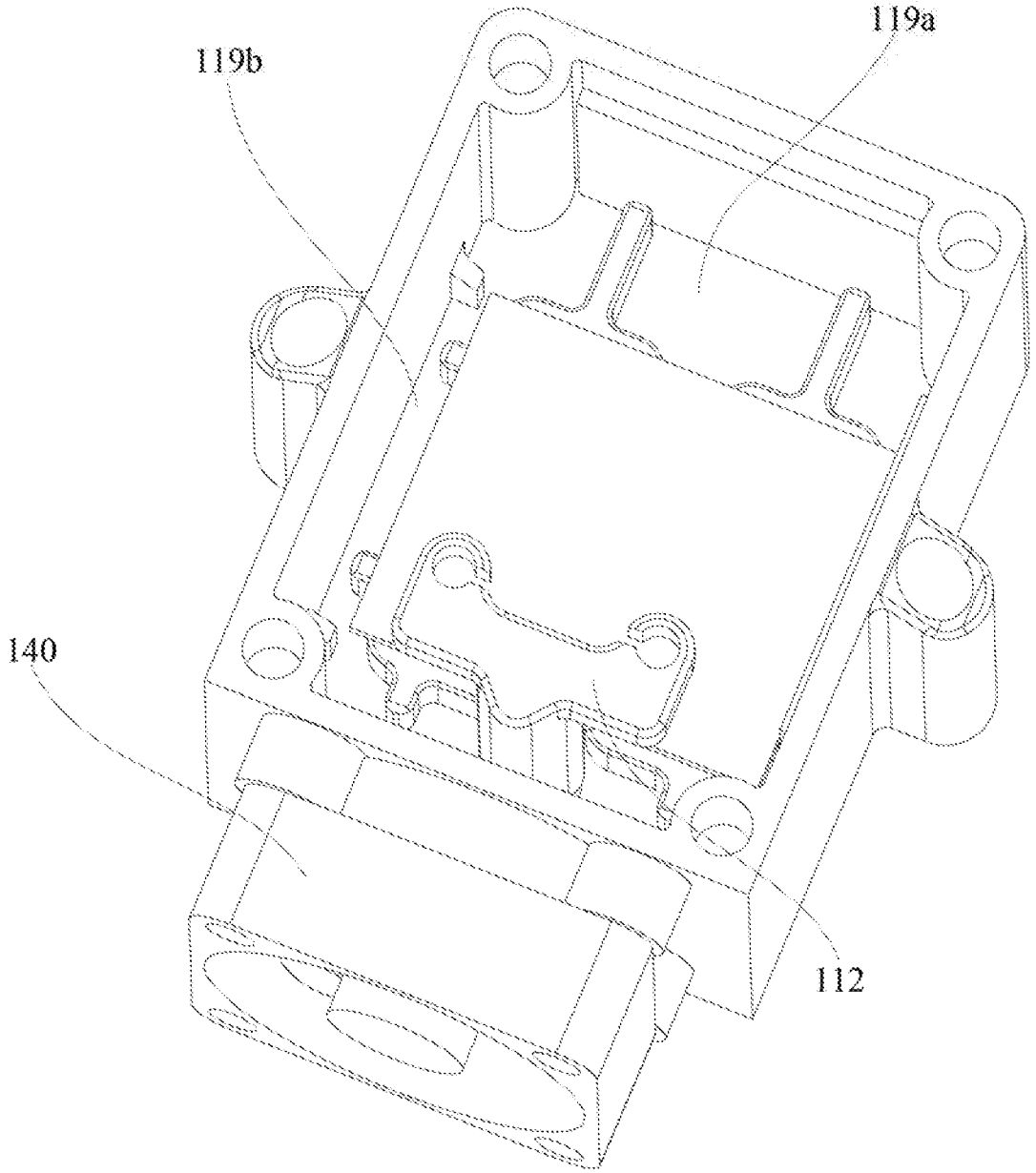
FIG. 4 is a perceptive view of a lower housing of the smog chamber of the smog machine as shown in FIG. 1.
Figure 5:
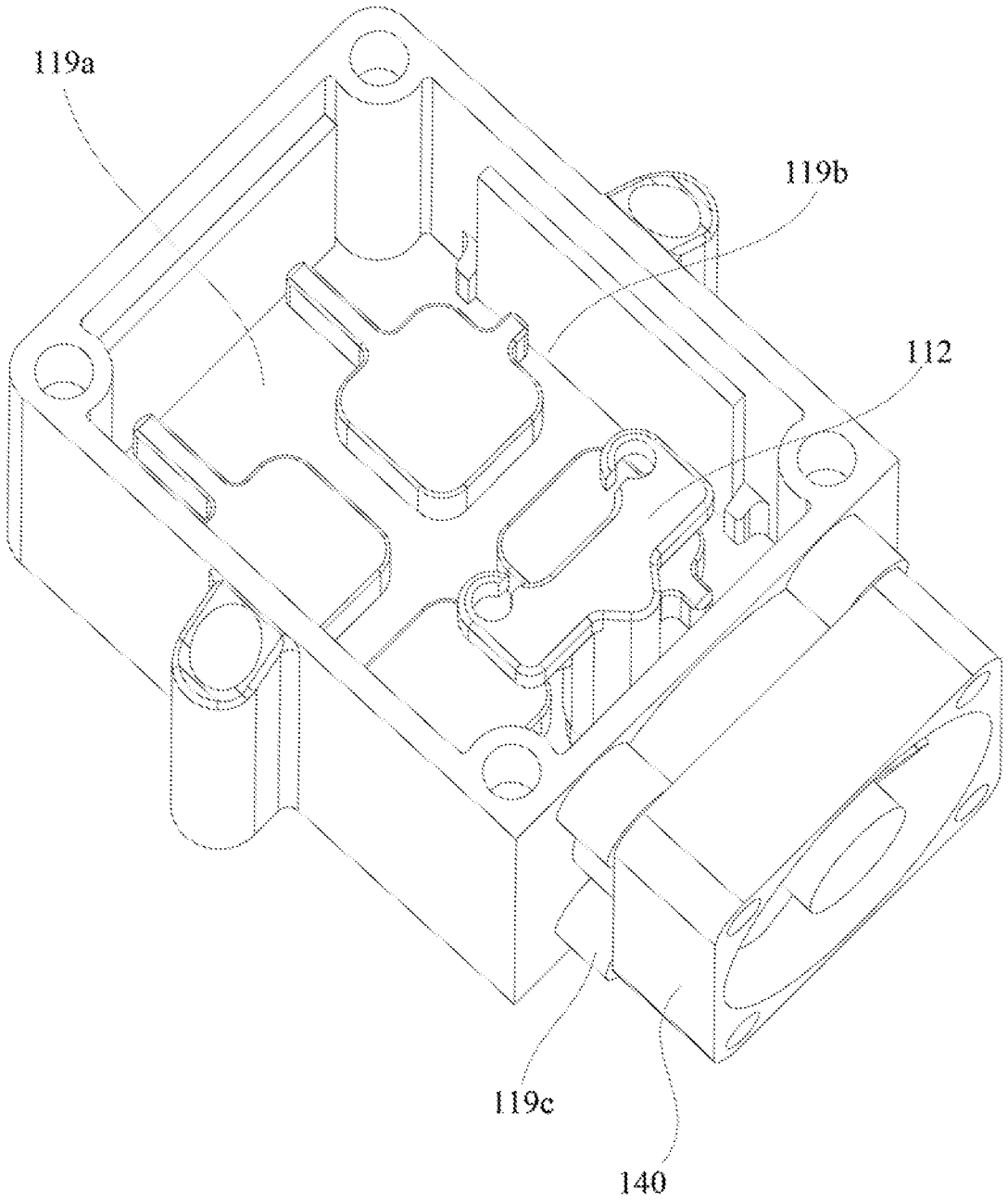
FIG. 5 is another perceptive view of the lower housing of the smog chamber of the smog machine as shown in FIG. 1.

Further, in order to receive the smog fluid, as shown in FIGS. 4-5, a fluid groove 119*a* may be provided on the bottom wall of the receiving cavity 111 of the smog chamber 110 and contains the smog fluid received. Specifically, in the illustrated embodiments, the fluid groove 119*a* may be extended to a sidewall of the receiving cavity 111, to form protrusions in the middle portion of the bottom wall of the receiving cavity 111 of the smog chamber 110.

Further, a wire-fixing pillar 112 used to fix the heating element 120 may be provided on the bottom wall of the receiving cavity 111, so as to avoid internal components from being damaged by heating.

The specific structure of the outlet 115 may be designed according to different requirements. For example, the outlet 115 may be an air exhaust tube connected with the smog chamber 110; the outlet 115 may be a window provided on the outer sidewall the smog chamber 110; or the outlet 115 may be a mesh provided on the outer sidewall on the smog chamber 110.

Specifically, in the illustrated embodiments, the outlet 115 may be provided on a top surface of the smog chamber 110, and the inlet 113 may be provided on the side surface of the smog chamber 110, such that the orientation of the outlet 115 intersect perpendicularly or inclinedly with the orientation of the inlet 113.

Figure 6:
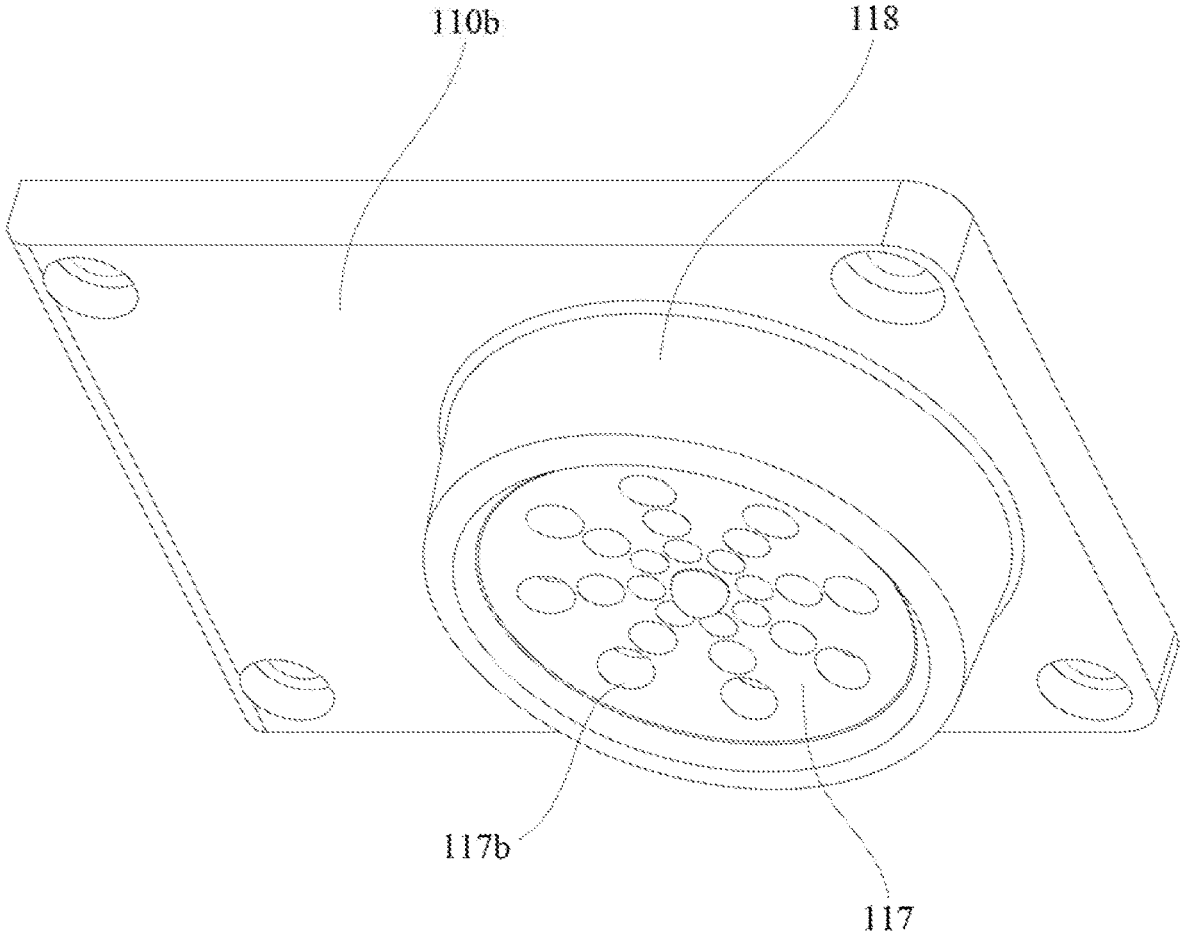
FIG. 6 is a perspective view of an upper cover of the smog chamber of the smog machine as shown in FIG. 1.
Figure 8:
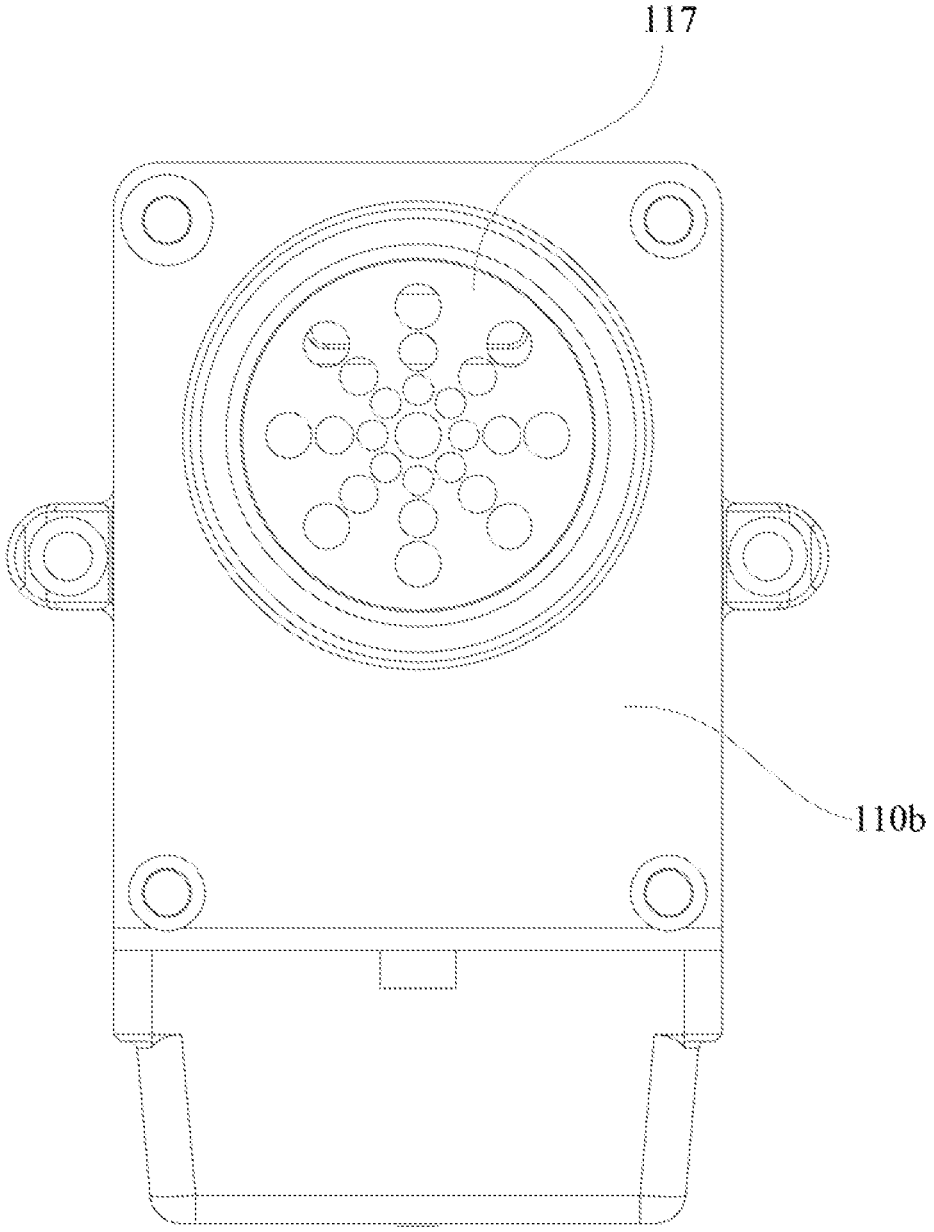
FIG. 8 is another perceptive view of the smog machine as shown in FIG. 1.

Referring to FIGS. 6-8, specifically, the outlet 115 may be a window provided on the top surface of the smog chamber 110, the smog chamber 110 may further comprise a covering plate 117 for covering the window, a surface of the covering plate 117 towards the receiving cavity 111 may form a bulged surface 117*a* bulging outward, and a ventilation mesh 117*b* penetrating through the bulged surface 117*a* may be provided on the covering plate 117.

Further, the bulged surface 117*a* may be in any convex shape, for example, a circular arc shape, an elliptical arc shape, a pyramid shape, a truncated pyramid shape, a truncated conical shape or a conical shape.

Further, the smog chamber 110 may also comprise a reflux tube 118 in communication with the outlet 115. One of the opening ends of the reflux tube 118 may be a large diameter end, and the other one of the opening ends of the reflux tube 118 may be a small diameter end. The large diameter end may be connected correspondingly with the outlet 115, and the covering plate 117 may be disposed at the small diameter end.

The heating element 120 may be mounted within the receiving cavity 111, and generate heat after being applied with an electric current to vaporize the smog fluid.

The heating element 120 may be heated by applying the electric current directly or indirectly. For example, in the illustrated embodiments, the heating element 120 may be electrically connected with a power line to directly apply the electric current to the heating element 120. In some embodiments, the smog machine 100 may further comprise an electromagnetic device configured to generate a variable frequency electromagnetic field, the heating element 120 may generate an induced electric current within the electromagnetic field generated by the electromagnetic device.

The specific structure of the heating element 120 may be designed according to different requirements. Specifically, in the illustrated embodiments, the heating element 120 may be a solid resistance wire or a hollow heating tube, and the heating element 120 may be wrapped with a cotton core (not shown) for absorbing the smog fluid.

Further, the heating element 120 may be bent into a U-shaped structure and disposed around three inner walls of the receiving cavity 111, and an opening formed by two ends of the heating element 120 may be disposed towards the inlet 113.

Further, as shown in FIGS. 4-5, there may be a plurality of fluid grooves 119*a* that are mutually independent, and the plurality of fluid grooves 119*a* may be used for holding different smog fluid and/or different colors of smog fluid. For example, the smog fluid may comprise glycerol, ethylene glycol, propylene glycol and colorant used for changing the color of the smog fluid. There may be a plurality of heating elements 120 configured for heating the smog fluid within the plurality of fluid grooves 119*a* respectively, thereby selectively generating different colors of smog.

Of course, in order to generate different colors of smog, other ways may be adopted. For example, in other embodiments, the smog machine 100 may further comprise an RGB LED disposed close to the outlet 115, a light beam generated by the RGB LED may illuminate on the smog coming out from the outlet 115.

Further, in order to improve the heating efficiency of the heating element 120, an auxiliary component configured to improve heat utilization may be disposed within the smog chamber 110. In the illustrated embodiments, the smog machine 100 may further comprise a reflective element 140 disposed close to the inner wall of the receiving cavity 111 for reflecting infrared radiation. For example, the reflective element 140 may be a glass sheet, a mirror, or a metal sheet.

In order to further improve the heating efficiency of the heating element 120, there may be a plurality of reflective elements 140 fixed respectively on the bottom wall and sidewall of the receiving cavity 111 of the smog chamber 110. The heating element 120 may be located among the plurality of reflective elements 140.

Further, in order to facilitate fixing the reflective element 140, the bottom wall of the receiving cavity 111 of the smog chamber 110*a* may be provided with fastening slots 119*b* close to the sidewall, the reflective elements 140 may be fastened within fastening slots 119*b*.

In some embodiments, the smog machine 100 may further comprise a heat insulation element disposed close to the inner wall of the receiving cavity 111 for preventing the heat of the receiving cavity 111 from leakage. For example, the heat insulation element may be a high temperature heat insulation plastic sheet or a layer of heat insulation cotton attached to the inner wall of the receiving cavity 111.

The air-blowing device 130 may be disposed corresponding to the inlet 113 for blowing an air flow towards the receiving cavity 111. In some embodiments, the air flow generated by the air-blowing device 130 may enter into the receiving cavity 111 of the smog chamber 110 from the inlet 113, and discharge the smog within the receiving cavity 111 of the smog chamber 110 from the outlet 115. The air-blowing device 130 may be a direct current (DC) centrifugal ventilator or a direct current fan.

Referring to FIG. 5, in the illustrated embodiments, the air-blowing device 130 may be a direct current fan, and the side surface of the smog chamber where the guiding ring 116 is located may be provided with a plurality of fixing pillars 119*c*. The top surface of the fixing pillars 119*c* may be provided with screw holes extending along their axes, and the direct current fan may be fixed onto the fixing pillars 119*c* by screw fasteners fitting into the screw holes of the fixing pillars 119*c* current fan.

Further, the plurality of fixing pillars 119*c* may be located at outer periphery of the guiding ring 116 and formed integrally with the guiding ring 116. An air outlet of the direct current fan may match the shape of the opening of the guiding ring 116.

Figure 9:
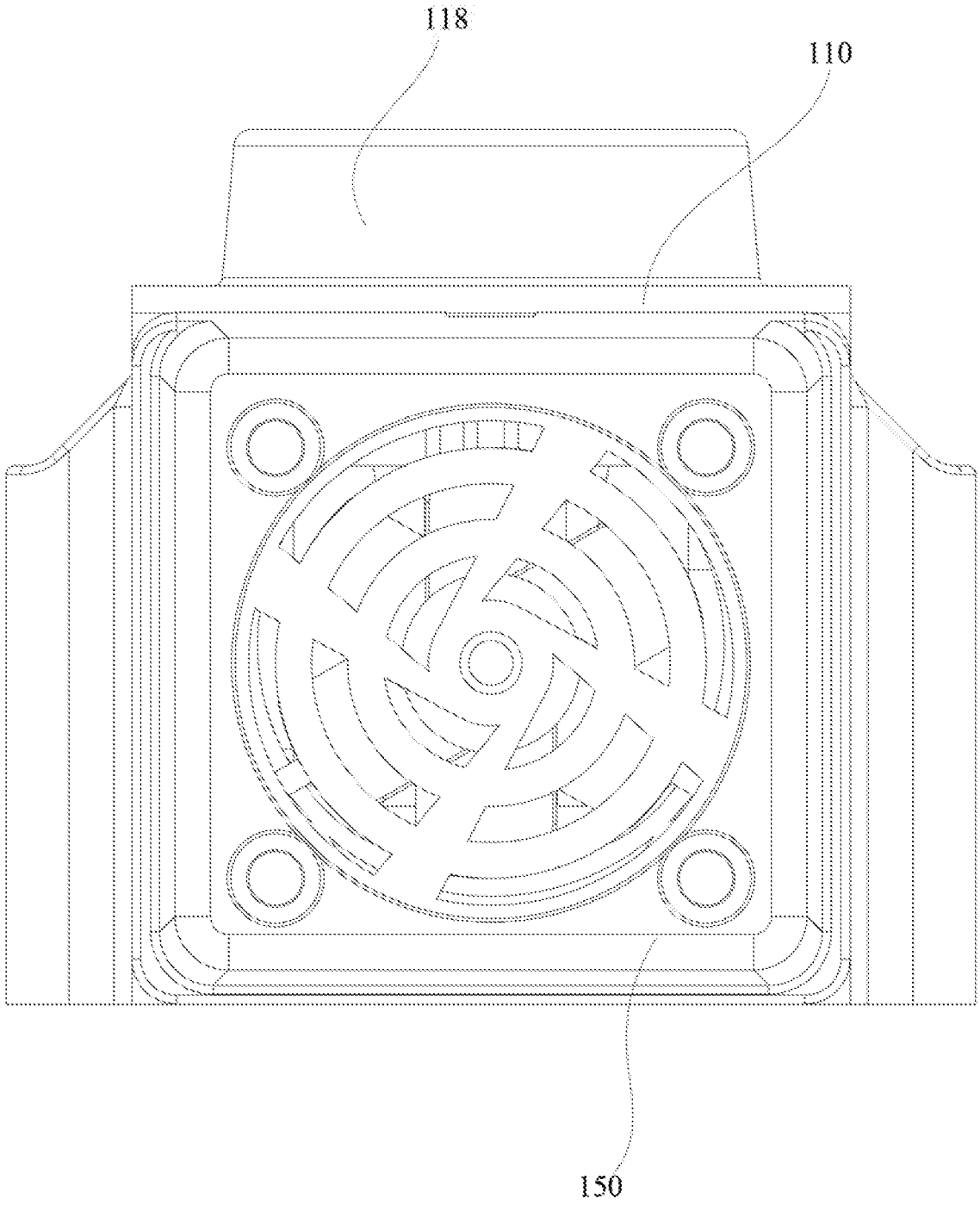
FIG. 9 is another perceptive view of the smog machine as shown in FIG. 1.

Further, referring to FIG. 9, the smog machine 110 may also comprise a fan casing 150 covering on the direct current fan and fixedly connected with the smog chamber 110.

When the illustrated smog machine 100 is assembled, the reflective element 140 may be fastened within the fastening slot 119*b* inside the smog chamber 110, and the wire-fixing pillar 112 may be assembled at screw holes' sites of the smog chamber 110 for fixing the heating element 120 in order to prevent internal components from being damaged. And the heating element 120 may be assembled on the reflective element 140 on the bottom wall of the receiving cavity 111 of the smog chamber 110. A sealing ring may be assembled on the lower housing 110*a*. At last, the upper cover 110*b* may be pressed tightly against the sealing gasket 110*c* through four screws and locked tightly on the lower housing 110*a*. The air-blowing device 130 may be disposed corresponding to the inlet 113 of the smog chamber 110 and be fixed together on the smog chamber 110 using the fan casing 150.

The upper cover 110*b* of the smog chamber 110 may have a plurality of vent holes arranged in circles to form the outlet 115 to facilitate the discharging of the smog. The inner surface of the covering plate 117 of the upper cover 110*b* of the smog chamber 110 may be provided with a bulged surface 117*a* and, in this way, the liquid condensed in the discharging of the smog may return into the main chamber smoothly, therefore preventing diffusion and contamination of the smog fluid.

The inlet 113 of the smog chamber 110 may be provided with an inclined guiding portion 116*a* to elevate a wind flow onto the upper half portion of the smog chamber 110 and, in this way, the smog may be discharged quickly, thereby preventing situations where a vortex may be formed inside the main chamber by a flow of smog and the smog may not be discharged. With such assembly manner, the inlet 113 mounted on the side surface may be achieved, and a wind flow inclined upward may be provided to discharge the smog uniformly upward, such smog chamber 110 may have a simple structure and generate a large amount of smog.

The heating element 120 may be wrapped with a cotton core into a high temperature smog fluid decomposition element to fit with the smog chamber 110, and the high temperature smog fluid decomposition element may form a distinct U-shaped strip. When the smog fluid is vaporized by the heating element 120, a uniform layer of smog may be generated on the U-shaped strip. The heating element 120 may be fixed on the smog chamber 110 using the wire-fixing pillar 112, enhancing the security and reliability.

The above-described smog machine 100 may have at least the following advantages:

(1) The above-described smog machine 100 may heat the smog fluid within the smog chamber 110 by the heating element 120, so as to vaporize the smog fluid into the smog, and to discharge the smog out of the smog chamber 110 by the air-blowing device 130. Thus, the above-described smog machine 100 has a more compact structure to facilitate the miniaturized design thereof.

(2) The above-described smog machine 100 may vaporize the smog fluid by electrical heating by the heating element 120, which is simple, quick, and controllable for producing smog.

(3) The above-described smog machine 100 may discharge the smog out of the smog chamber 110 through the air-blowing device 130, so as to cause the smog within the smog chamber 110 to flow out quickly, having a higher efficiency for producing smog, and capable of producing a large amount of smog in a short time.

(4) The above-described smog machine 100 may have a bulged surface 117*a* provided on the inner surface of the covering plate 117 of the smog chamber 110, in this way the liquid condensed during the discharging of the smog may return into the main chamber smoothly, thereby preventing diffusion and contamination of the smog fluid.

(5) The inlet 113 of the smog chamber 110 of the above-described smog machine 100 may be provided with an inclined guiding portion 116*a* to elevate the wind flow to the upper half portion of the smog chamber 110, such that the smog may be discharged quickly, and it can prevent a flow of smog from forming a vortex within the main chamber, thereby further improving the efficiency for generating the smog.

Based on the above-described smog machine 100, the present disclosure further provides a method for prompting state information of a physical game character utilizing the above-described smog machine 100.

The prompting method, according to an embodiment, may utilize the smog produced by the above-described smog machine 100 to characterize the state information of the physical game character, the specific structure of the smog machine 100 may be described as above and details will be omitted herein.

Figure 10:
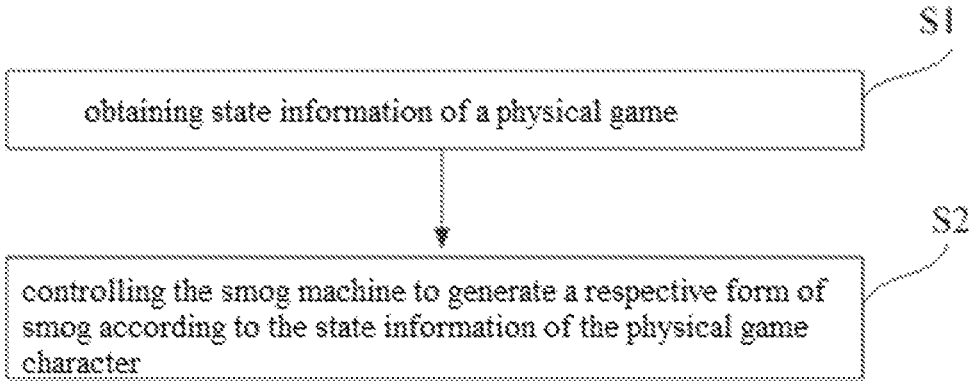
FIG. 10 is a flow chart of a method for prompting a state information of a physical game character according to an embodiment of the present disclosure.

Referring to FIG. 10, the prompting method may comprise steps as follows:

Step S1, obtaining state information of a physical game character.

The state information of the physical game character may be in a variety of categories. For example, the state information of the physical game character may be one or more of: life value (e.g., a number of lives or life lines), getting shot, hitting a landmine, being frozen, being dizzied, being died, and the like.

For example, when it is required to know whether the physical game character is shot or hit by an external projectile in a game, a respective state information may be generated to alert a game participant, a controller or a referee. The external projectile may be a material object, for example a BB pellet, a potato, a rock, a water bomb, a snowball and the like, or may also be a light beam, for example, an infrared ray, a laser beam and the like. That is, the state information may be generated when the physical game character is shot by the external light beam and/or the material object.

The state information of the physical game character may be obtained by its own sensor. For example, the sensor pray comprise at least one of the followings: an acceleration sensor, an infrared sensor, a motion sensor, a proximity sensor, a visual sensor, a position sensor, and a distance sensor, etc.

The physical game character may comprise at least one of the followings: a terrestrial fixed facility, a remote-control terrestrial moving device, a remote-control aerial moving device, and a remote-control overwater moving device, etc.

In some embodiments, the physical game character may be the terrestrial fixed facility, for example, a gun turret, a guard tower and an obstacle-wall and the like in a game simulating an actual war.

The physical game character may also be a remote-control terrestrial moving device, for example, a remote-control toy fighting vehicle, a remote-control toy robot or the like.

The physical game character may also be a remote-control aerial moving device, for example, an unmanned aerial vehicle (UAV), a remote-control balloon or the like.

The physical game character may also be a remote-control overwater moving device, for example, a remote-control toy warship, a remote-control toy powerboat or the like.

The physical game character may also be a remote-control underwater moving device, for example, a remote-control toy fish, a remote-control toy submarine or the like.

The physical game character may further be a real person, or a manned terrestrial moving device, a manned overwater moving device, a manned underwater moving device, a manned aerial moving device or the like.

Step S2, controlling the smog machine 100 to generate a respective form of smog according to the state information of the physical game character.

The smog may be in a variety of forms. For example, the form of the smog may comprise at least one of the followings: a concentration of the smog, a time point when the smog is generated, and color of the smog, etc.

Different state information of the physical game character may be represented by different forms of the smog. For example, in some embodiments, the state information of the physical game character may be change information of the life value. When the life value for the physical game character is below a preset greater-than-zero value, the smog machine 100 may be controlled to start to generate the smog.

In some embodiments, the state information of the physical game character may be the change information of the life value of the physical game character. When the life value for the physical game character changes to zero, the smog machine 100 may be controlled to start to generate the smog.

In some embodiments, the state information of the physical game character may be the change information of the life value of the physical game character. When the life value for the physical game character is blew a preset greater-than-zero value, the smog machine 100 may be controlled to generate the smog in one color; when the life value for the physical game character is zero, the smog machine 100 may be controlled to generate the smog in another color.

In some embodiments, the state information of the physical game character may be the change information of the life value of the physical game character. When the life value for the physical game character is blew a preset greater-than-zero value, the smog machine 100 may be controlled to generate the smog with a smaller concentration; when the life value for the physical game character is zero, the smog machine 100 may be controlled to generate the smog with a larger concentration.

The above-described prompting method may at least have advantages as follows:

(1) The above-described prompting method may prompt the state information of the physical game character by the smog produced by the smog machine 100, so as to facilitate a game participant to be able to see clearly the state information of the physical game character at different viewing angles, and to achieve a good visual effect.

(2) The above-described prompting method may produce different forms of smog by the smog machine 100 to characterize different state information of the physical game character, and better adaptability may be achieved.

Based on the above-described smog machine 100, the present disclosure may further provide a prompting device utilizing the above-described smog machine 100.

Figure 11:
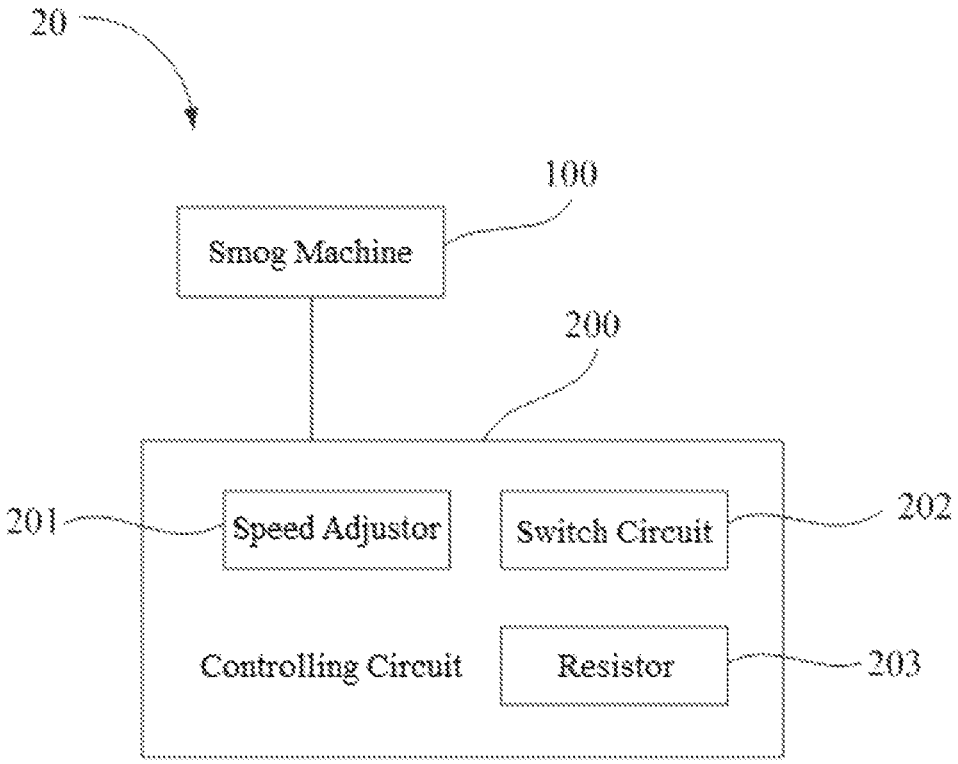
FIG. 11 is a principle diagram of a prompting device for prompting a state information of a physical game character according to an embodiment of the present disclosure.

Referring to FIG. 11, the prompting device 20 according to an embodiment may be configured to prompt state information of a physical game character. The prompting device 20 may comprise a smog machine 100 and a controlling circuit 200.

The specific structure of the smog machine 100 may be described as above, and details will be omitted herein.

The controlling circuit 200 may be configured to control the smog machine 100 to generate smog that may characterize the state information of the physical game character. The controlling circuit 200 may control the smog machine 100 in one or more of the following ways: controlling power-on or power-off of the heating element 120, controlling a magnitude of the electric current on the heating element 120, controlling the power-on time of the heating element 120, controlling the color of the smog generated by the smog machine 100, and controlling the amount of air flow generated by the air-blowing device 130, etc.

For example, when it is required to start producing smog or stop producing the smog, the controlling circuit 200 may control the power-on or power-off of the heating element 120, thereby controlling the heating element 120 to start heating or stop heating the smog fluid.

When it is required to increase or reduce the concentration of the produced smog, the magnitude of electric current on the heating element 120 may be controlled by the controlling circuit 200. The larger the current passing through the heating element 120, the higher the heated temperature, and the larger the amount of the vaporized smog.

If the smog chamber of the smog machine 100 is provided with a plurality of independent fluid grooves 119*a* when it is required to produce different colors of smog, different colors of smog fluid may be held within each of the plurality of fluid grooves 119*a* and a corresponding heating element 120 may be provided. The heating element 120 with the respective color of smog fluid may be powered on selectively by the controlling circuit 200, to generate a respective color of smog. If the smog machine 100 further comprises an RGB LED disposed close to the outlet 115, when it is required to produce different colors of smog, the RGB LED may be controlled by the controlling circuit 200 to generate a respective light beam to illuminate on the smog coming out from the outlet 115, rendering the smog into a corresponding color.

The specific structure of the controlling circuit 200 may be designed according to different requirements. For example, the controlling circuit 200 may comprise at least one of the followings: a speed adjustor 201, a switch circuit 202, a resistor 203, and a microprocessor (not shown), etc.

For example, when the heating element 120 is connected with a power line to power on the heating element 120, then the controlling circuit 200 may comprise a switch circuit 202 for controlling the power line to be on or oft and a resistor 203 to regulate the magnitude of the current on the heating element.

When the smog machine 100 further comprises an electromagnetic device for generating a variable frequency electromagnetic field, the heating element 120 may generate an induced current within the electromagnetic field generated by the electromagnetic device, and the controlling circuit 200 may comprise a switch circuit 202 for controlling an operational state of the electromagnetic device.

When the air-blowing device 130 is a direct current centrifugal ventilator or a direct current fan, the controlling circuit 200 may comprise a speed adjustor 201 for controlling a rotating speed of the air-blowing device 130, and a switch circuit 202 for controlling a power-on or power-off of the air-blowing device 130.

The controlling circuit 200 may control the smog machine 100 to generate a respective form of smog, according to the different state information of the physical game character. For example, the controlling circuit 200 may control the smog machine 100 to generate different concentrations and/or different colors of smog, to characterize the life value for the physical game character.

In some embodiments, when the life value for the physical game character is below a preset greater-than-zero value, the controlling circuit 200 may control the smog machine 100 to start to generate the smog.

In some embodiments, when the life value for the physical game character is zero, the controlling circuit 200 may control the smog machine 100 to start to generate the smog.

In some embodiments, when the life value for the physical game character is below a preset greater-than-zero value, the controlling circuit 200 may control the smog machine 100 to start to generate the smog in one color; when the life value for the physical game character is zero, the controlling circuit 200 may control the smog machine 100 to start to generate the smog in another color.

In some embodiments, when the life value for the physical game character is below a preset greater-than-zero value, the controlling circuit 200 may control the smog machine 100 to start to generate the smog with a smaller concentration; when the life value for the physical game character is zero, the controlling circuit 200 may control the smog machine 100 to start to generate the smog with a larger concentration.

The above-describe prompting device 20 may at least have advantages as follows:

(1) The above-described prompting device 20 may prompt the state information of the physical game character by the smog produced by the smog machine 100, so as to facilitate a game participant to be able to see clearly the state information of the physical game character at different viewing angles, and to achieve a good visual effect.

(2) The above-described prompting device 20 may produce different forms of smog by the smog machine 100 to characterize the different state information of the physical game character, and better adaptability may be achieved.

Based on the above-described prompting device 20, the present disclosure may further provide a physical game character employing the above-described prompting device 20. The physical game character may be a terrestrial fixed facility, for example, a gun turret, a guard tower and an obstacle-wall and the like in a game simulating an actual war. The physical game character may be a remote-control terrestrial moving device, for example, a remote-control toy fighting vehicle, a remote-control toy robot and the like. The physical game character may also be a remote-control aerial moving device, for example, an unmanned aerial vehicle (UAV), a remote-control balloon and the like. The physical game character may also be a remote-control over water moving device, for example, a remote-control toy warship, a remote-control toy powerboat and the like. The physical game character may also be a remote-control underwater moving device, for example, a remote-control toy fish, a remote-control toy submarine and the like. Below may be described taking the remote-control fighting vehicle as an example in connection with the drawings.

Figure 12:
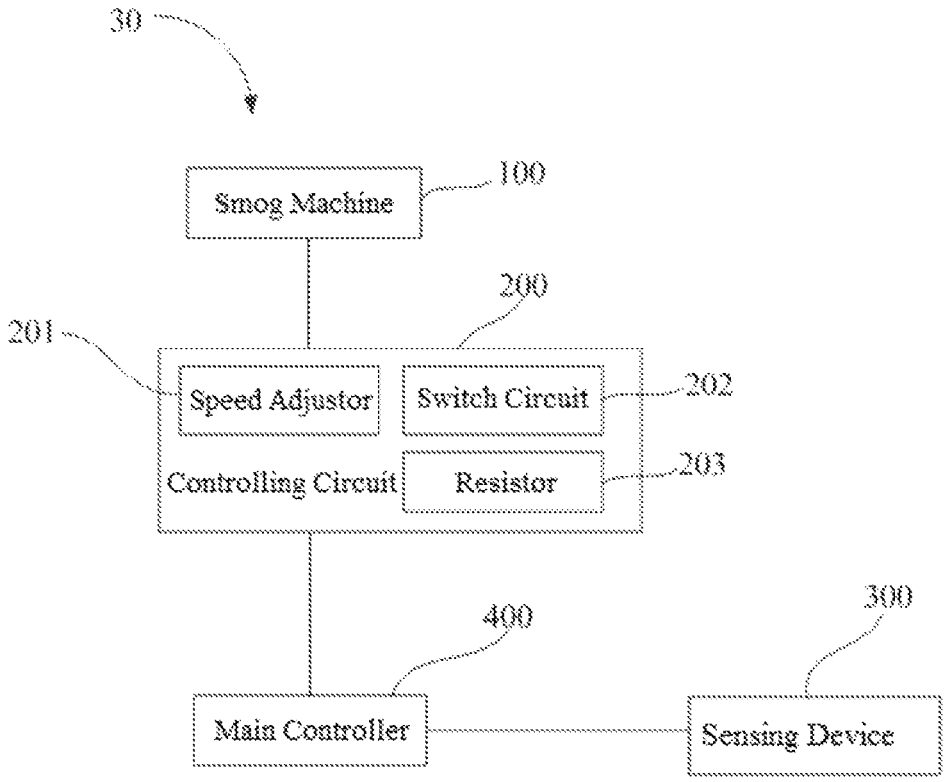
FIG. 12 is a principle diagram of a remote-control fighting vehicle according to an embodiment of the present disclosure.

Referring to FIG. 12, the remote-control fighting vehicle 30 according to an embodiment may comprise a prompting device 20, a sensing device 300, and a main controller 400. The specific structure of the prompting device 20 may be described as above, and details thereof will be omitted herein.

The sensing device 300 may be configured to detect whether it is shot by an external projectile and generate a respective sensing signal. The external projectile may be a material object, for example, a BB pellet, a potato, a rock, a water bomb, a snowball and the like, or may also be a light beam. For example, the external light beam may comprise at least one of visible light and invisible light, for example, an infrared ray, a laser beam and the like.

Specifically, in the illustrated embodiments, the sensing device 300 may comprise a sensor disposed on the outer surface of the remote-control fighting vehicle 30, the sensor may be configured to detect whether or not the outer surface of the remote-control fighting vehicle is hit by an external projectile.

Specifically, the sensor may comprise at least one of the followings: an acceleration sensor, an infrared ray sensor, a motion sensor, a proximity sensor, a visual sensor, a position sensor, and a distance sensor, etc. For example, when the external projectile is an infrared light beam, the sensor may be an infrared sensor; when the external projectile is a material object, for example, a BB pellet, a potato, a rock, a water bomb, a snowball and the like, the sensor may be an acceleration sensor, a motion sensor, a proximity sensor, a visual sensor, a position sensor, a distance sensor and/or the like.

The main controller 400 may be connected to and in communication with the controlling circuit 200 and the sensing device 300 for receiving a sensing signal and outputting a respective control signal to the controlling circuit 200 according to the sensing signal. The main controller 400 may be an integrated control board, a microprocessor or the like. The controlling circuit 200 and the main controller 400 may be provided separately, or may be integrated together.

The main controller 400 may control the smog machine 100 to generate different forms of smog, for example, different concentrations of smog, different generating times of smog, and different colors of smog, etc.

The controller may prompt using different forms of smog according to the different state information of the remote-control fighting vehicle 30. For example, in some embodiments, the state information of the remote-control fighting vehicle 30 may be change information of the life value of the remote-control fighting vehicle 30; when the life value of the remote-control fighting vehicle 30 is below a preset greater-than-zero value, the smog machine 100 may be controlled to start to generate the smog.

In some embodiments, the state information of the remote-control fighting vehicle 30 may be change information of the life value of the remote-control fighting vehicle 30; when the life value for the remote-control fighting vehicle 30 is zero, the smog machine 100 may be controlled to start to generate the smog.

In some embodiments, the state information of the remote-control fighting vehicle 30 may be change information of the life value of the remote-control fighting vehicle 30; when the life value for the remote-control fighting vehicle 30 is below a preset greater-than-zero value, the smog machine 100 may be controlled to start to generate the smog in one color; when the life value for the remote-control fighting vehicle 30 is zero, the smog machine 100 may be controlled to start to generate the smog in another color.

In some embodiments, the state information of the remote-control fighting vehicle 30 may be change information of the life value of the remote-control fighting vehicle 30; when the life value for the remote-control fighting vehicle 30 is below a preset greater-than-zero value, the smog machine 100 may be controlled to start to generate the smog with a smaller concentration; when the life value for the remote-control fighting vehicle 30 is zero, the smog machine 100 may be controlled to start to generate the smog with a larger concentration.

The above-described remote-control fighting vehicle 30 may have at least the following advantages:

(1) The above-described remote-control fighting vehicle 30 may prompt the state information of the physical game character by the smog generated by the smog machine 100, so as to facilitate a game participant to be able to see clearly the state information of the physical game character at different viewing angles and to operate the remote-control fighting vehicle 30.

(2) The above-described prompting device 20 may produce different forms of smog by the smog machine 100 to characterize different state information of the physical game character, such that the game participant cyan manipulate the remote-control fighting vehicle 30 more flexibly.

In the several embodiments provided by the present disclosure, it should be understood that, the disclosed related devices and methods may be implemented by other ways. For example, the above described device embodiments are merely illustrative. For example, the division of the modules or units is merely a logic function division, and other division manners may be employed when it is actually implemented. For example, more units or components may be combined or may be integrated into another system. Alternatively, some features may be omitted or not be performed. Additionally, couplings or direct couplings or communicative connections between one and another as displayed or discussed may be indirect couplings or communicative connections via some interfaces, devices or units, or may be in electric, mechanical or other forms.

Units described as separate parts may or may not be separated physically. Components displayed as units may or may not be physical units, i.e., may be located in one place, or may be distributed onto a plurality of network units. Some or all of the units may be selected in order to achieve the objects of the solutions of the embodiments according to the actual requirements.

Additionally, various functional units in various embodiments according to the present disclosure may be integrated into one processing unit, or may be physically separate units. Two or more of the various functional units may be integrated into one unit. The above integrated unit may be implemented in a form of hardware or in a form of software functional units.

The integrated units, if being implemented in a form of software functional units and being independent products for sale and use, may be stored in one computer-readable storage medium. Based on such understandings, the technical solution of the present disclosure or the part of which contributes to the prior art or some or all of the technical solution may be embodied in a form of a software product. The software product may be stored in one storage medium, and comprise several instructions for causing the computer processor to execute some or all of steps of the methods in various embodiments according to the present disclosure. The above-mentioned storage medium may comprise: a USB flash disk, a movable hard disc, a Read-Only Memory (ROM), a random access memory (RAM), a diskette or an optical disc and various medium capable of storing program codes.

The foregoing disclosure is merely illustrative of the embodiments of the present disclosure, and is not intended to limit the scope of the present disclosure. Any equivalent structural or procedural variations made on the basis of the description and the drawings of the present disclosure, and their direct or indirect applications to other relevant technical fields, shall all fall into the scope of the present disclosure.

What is claimed is:

1. A prompting device for prompting state information of a physical game character, comprising:

a smog machine comprising a smog chamber, a heating element and an air-blowing device, wherein:

the smog chamber has a receiving cavity for receiving smog fluid, an inlet, and an outlet, and the inlet and the outlet are in communication with the receiving cavity;

the heating element is mounted within the receiving cavity, the heating element generates heat to vaporize the smog fluid after an electric current is applied, the heating element is a solid resistance wire or a hollow heating tube, and the heating element is wrapped with a cotton core for absorbing the smog fluid; and the air-blowing device is disposed corresponding to the outlet for blowing an air flow towards the receiving cavity, and the air flow generated by the air-blowing device enters into the receiving cavity from the inlet and discharges smog within the receiving cavity from outlet; and a controlling circuit configured to control the smog machine to generate the smog that characterizes the state information of the physical game character.

2. The prompting device according to claim 1, wherein the controlling circuit controls the smog machine by at least one of: controlling power-on and power-off of the heating element, controlling a magnitude of a current on the heating element, controlling a power-on time of the heating element, controlling a color of the smog generated by the smog machine, or controlling an amount of the air flow generated by the air-blowing device.

3. The prompting device according to claim 1, wherein the controlling circuit controls a different concentration and/or different color of the smog generated by the smog machine to characterize a life value for the physical game character.

4. The prompting device according to claim 3, wherein, when the life value for the physical game character is below a preset greater-than-zero value, the controlling circuit controls the smog machine to start to generate the smog; or when the life value for the physical game character is zero, the controlling circuit controls the smog machine to start to generate the smog; or when the life value for the physical game character is below the preset greater-than-zero value, the controlling circuit controls the smog machine to start to generate the smog in one color; when the life value for the physical game character is zero, the controlling circuit controls the smog machine to start to generate the smog in another color; or when the life value for the physical game character is below the preset greater-than-zero value, the controlling circuit controls the smog machine to start to generate the smog with a smaller concentration; when the life value for the physical game character is zero, the controlling circuit controls the smog machine to start to generate the smog with a larger concentration.

5. The prompting device according to claim 1, wherein there is a plurality of fluid grooves that are mutually independent, the plurality of fluid grooves are configured to hold different colors of smog fluid; and there is a plurality of heating elements configured respectively for heating the smog fluid within the plurality of fluid grooves.

6. The prompting device according to claim 1, wherein the heating element is bent into a U-shaped structure disposed around three inner walls of the receiving cavity, and an opening formed by two ends of the heating element is disposed towards the inlet.

7. The prompting device according to claim 1, further comprising a reflective element disposed close to an inner wall of the receiving cavity for reflecting infrared radiation.

8. The prompting device according to claim 7, wherein the reflective element is a glass sheet, a mirror, or a metal sheet.

9. A remote-control fighting vehicle, comprising:

a prompting device including:

a smog machine comprising a smog chamber, a heating element and an air-blowing device, wherein:

the smog chamber has a receiving cavity for receiving smog fluid, an inlet and an outlet, the inlet and the outlet are in communication with the receiving cavity;

the heating element is mounted within the receiving cavity, the heating element generates heat after galvanized to vaporize the smog fluid; and the air-blowing device is disposed corresponding to the outlet for blowing an air flow towards the receiving cavity; the air flow generated by the air-blowing device enters into the receiving cavity from the inlet and discharges smog within the receiving cavity from outlet; and a controlling circuit configured to control the smog machine to generate the smog that characterizes the state information of the physical game character;

a sensing device configured for detecting whether it is hit by an external projectile and generating a respective sensing signal, wherein the sensing device comprises a sensor disposed on an outer surface of the remote-control fighting vehicle and configured for detecting whether the outer surface of the remote-control fighting vehicle is bit by the external projectile; and a main controller connected in communication with the controlling circuit and the sensing device, for receiving the sensing signal, and outputting a respective control signal to the controlling circuit according to the sensing signal.

10. The remote-control fighting vehicle according to claim 9, wherein the sensor comprises at least one of: an acceleration sensor, an infrared sensor, a motion sensor, a proximity sensor, a visual sensor, a position sensor, or a distance sensor.

11. A prompting method for prompting state information of a physical game character using a smog machine, wherein the smog machine includes a smog chamber having a receiving cavity, an inlet, and an outlet, wherein the inlet and the outlet are in communication with the receiving cavity, and the receiving cavity is configured for receiving smog fluid; a heating element mounted within the receiving cavity, the heating element being configured to generate heat to vaporize the smog fluid after an electric current is applied, the heating element being a solid resistance wire or a hollow heating tube, and the heating element being wrapped with a cotton core for absorbing the smog fluid; and an air-blowing device disposed corresponding to the inlet for blowing an air flow towards the receiving cavity, wherein the air flow generated by the air-blowing device enters into the receiving cavity from the inlet and discharges smog within the receiving cavity from the outlet; and wherein the prompting method comprises:

obtaining the state information of the physical game character; and controlling the smog machine to generate a respective form of smog according to the state information of the physical game character.

12. The prompting method according to claim 11, wherein the state information of the physical game character comprises at least one of: life value, getting shot, hitting a landmine, hitting a trap, being frozen, being dizzied, or being died.

13. The prompting method according to claim 11, wherein the state information of the physical game character is obtained by a sensor comprising at least one of: an acceleration sensor, an infrared ray sensor, a motion sensor, a proximity sensor, a visual sensor, a position sensor, or a distance sensor.

14. The prompting method according to claim 11, wherein the form of the smog comprises at least one of: a concentration of the smog, time when the smog is generated, or a color of the smog.

15. The prompting method according to claim 11, wherein the state information of the physical game character is change information of the life value of the physical game character.

16. The prompting method according to claim 15, wherein the smog machine is controlled to start to generate the smog when the life value for the physical game character is below a preset greater-than-zero value; or the smog machine is controlled to start to generate the smog when the life value for the physical game character is zero; or the smog machine is controlled to start to generate the smog in one color when the life value for the physical game character is below the preset greater-than-zero value; the smog machine is controlled to start to generate the smog in another color when the life value for the physical game character is zero; or the smog machine is controlled to start to generate the smog with a smaller concentration when the life value for the physical game character is below the preset greater-than-zero value; the smog machine is controlled to start to generate the smog with a larger concentration when the life value for the physical game character is zero.

17. The prompting method according to claim 11, wherein the physical game character comprises at least one of: a terrestrial fixed facility, a remote-control terrestrial moving device, a remote-control aerial moving device, a remote-control overwater moving device, or a remote-control underwater moving device.

18. The prompting method according to claim 11, wherein the state information is generated when the physical game character is shot by an external light beam and/or a material object, the external light beam comprising at least one of visible light or invisible light.

* * * * *